United States Patent [19]

Breslow

[11] 4,004,803

[45] Jan. 25, 1977

[54] GAME APPARATUS WITH TIMER-CONTROLLED RECEPTACLE CLOSURE

[75] Inventor: Jeffrey D. Breslow, Highland Park, Ill.

[73] Assignee: Marvin Glass & Associates, Chicago, Ill.

[22] Filed: Oct. 20, 1975

[21] Appl. No.: 623,810

[52] U.S. Cl. ..... 273/1 R; 273/120 R

[51] Int. Cl.[2] ..... A63F 9/00

[58] Field of Search ..... 273/1 R, 1 E, 118 D, 273/120 R, 120 A

[56] References Cited

UNITED STATES PATENTS

| | | | |
|---|---|---|---|
| 3,565,425 | 2/1971 | Breslow | 273/1 R |
| 3,565,440 | 2/1971 | Glass et al. | 273/1 R |
| 3,687,451 | 8/1972 | Breslow | 273/1 R |
| 3,787,050 | 1/1974 | Goldfarb | 273/1 R |

*Primary Examiner*—Richard C. Pinkham
*Assistant Examiner*—Harry G. Strappello
*Attorney, Agent, or Firm*—Coffee and Sweeney

[57] ABSTRACT

A game apparatus involving the use of numbered cards, a closeable receiving area and an interval timer. The timer is controlled by a propelled ball which moves along the inside of an inverted conical surface disposed beneath the receiving area such that after a random interval of time the ball will fall through an aperture at the bottom of the concave surface thereby triggering a pair of spring loaded shutters which then close the receiving area. Each card has two numbers printed thereon. The first number is the number of the card, the second number indicates the number of the next card to be played. The cards are deposited in the receiving area until the shutters close thereby prohibiting further play.

12 Claims, 7 Drawing Figures

GAME APPARATUS WITH TIMER-CONTROLLED RECEPTACLE CLOSURE

BACKGROUND AND SUMMARY OF THE INVENTION

There are many games which include cards for instructions, for example, on how to proceed with the game or for reward. There also are many games where the players work against time, usually a given and known time interval. The present invention presents a random time period in conjunction with cards. The cards decide which player is next to play a card and if the card is not played within the required time, the player is out. A closeable receptacle is provided in which the players deposit the cards. The receptacle is closed automatically at the end of the random time period.

DESCRIPTION OF THE PREFERRED EMBODIMENT

Figure 1:
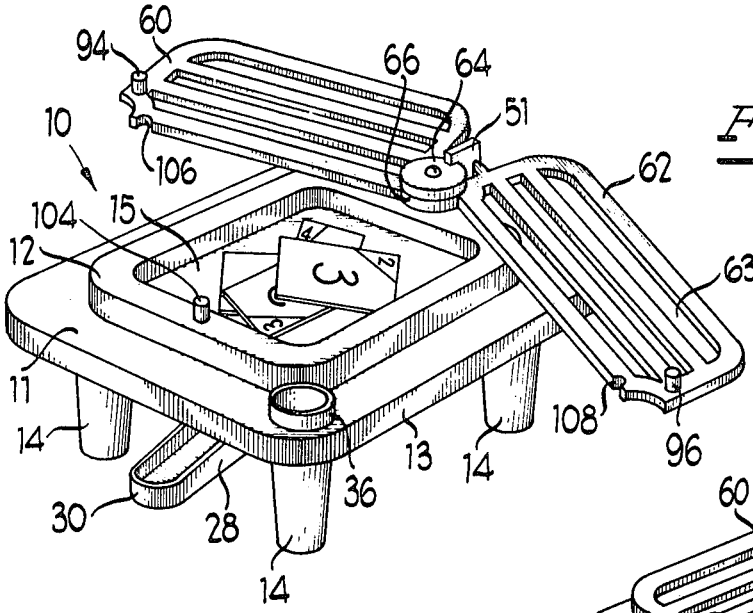
FIG. 1 is a perspective view of the game apparatus of this invention, with the shutters in an open position.
Figure 2:
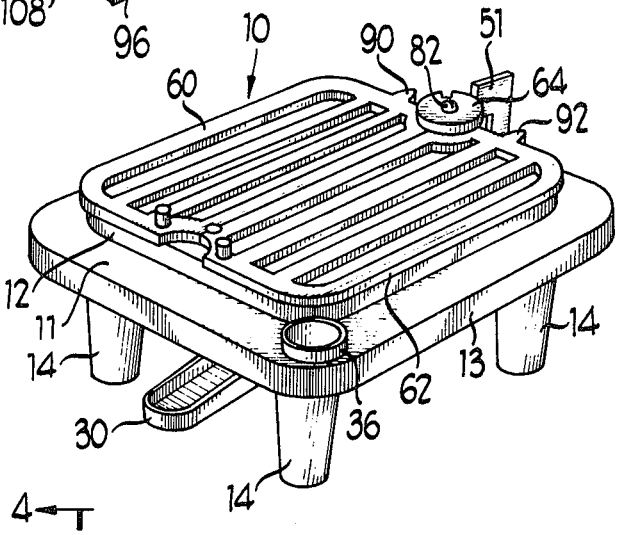
FIG. 2 is a perspective view of the game apparatus of this invention, with the shutters in a closed position.

Referring to FIG. 1, the game apparatus of the present invention, generally designated 10, includes a frame 11 which is a molded plastic piece, rectangular in shape, with a raised generally rectangular ridge 12. The ridge 12 which is of a rectangular hollow cross section, is disposed inwardly from the edge of the frame 11 and extends upward to form a card receiving receptacle 15 having a floor 15*a* within the frame 11. Additionally, the four corners of the frame 11 are rounded and the entire peripheral edge comprises a lip 13 depending downwardly from the frame 11. The frame 11 is supported by four circular tapered truncated legs 14, of which three are shown in FIGS. 1 and 2.

Figure 4:
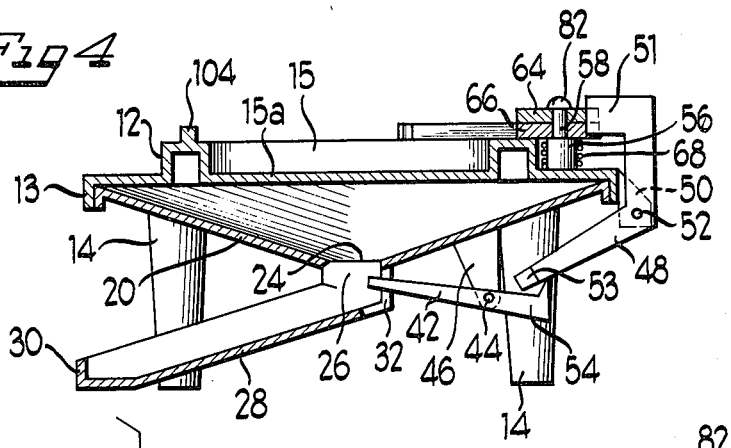
FIG. 4 is a vertical sectional view taken generally along the line 4—4 of FIG. 3.

Referring to FIG. 4, an inverted conical surface 20 is attached to and depends downwardly from the lip 13. The bottom of the conical surface has a circular aperture 24. A tubular section 26 surrounds the aperture 24 and is attached to the underside of the surface 20 and depends downwardly therefrom.

A vertical elongated slot 32 is provided in the rear portion of the tubular section 26 for a purpose to be explained later. A chute 28 is attached to and slopes downwardly from the tubular section 26 terminating at an end wall 30.

Figure 3:
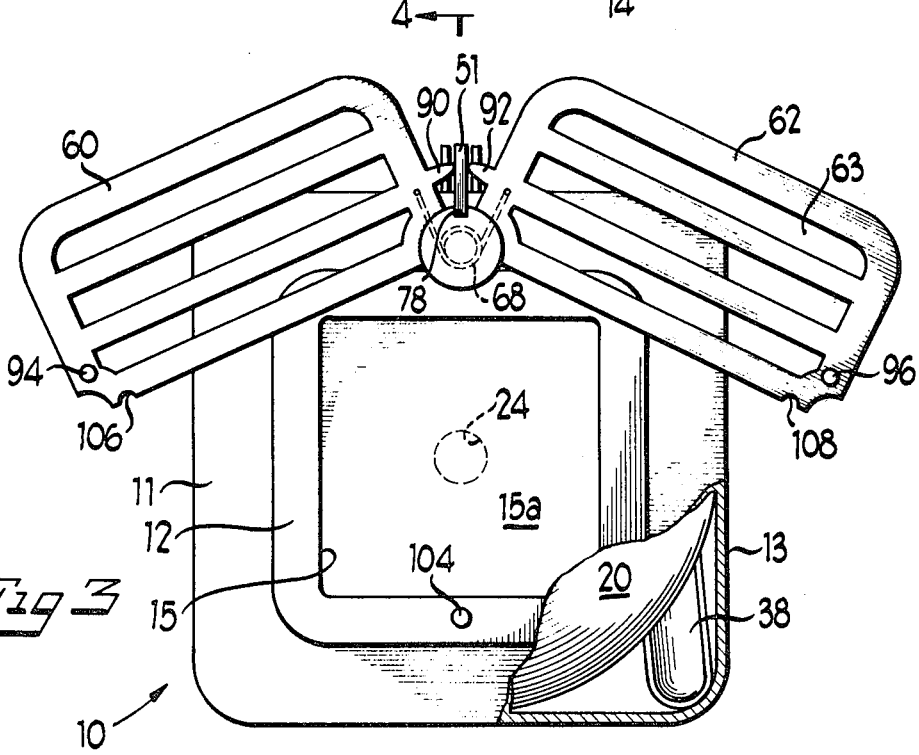
FIG. 3 is a top plan view, on an enlarged scale, of the game apparatus as shown in FIG. 1.

Referring to FIGS. 1 and 3, a circular opening 36 is provided in a front, righthand corner portion of the frame 11, which opening extends vertically to a ramp 38 which leads to the conical surface 20.

Figure 5:
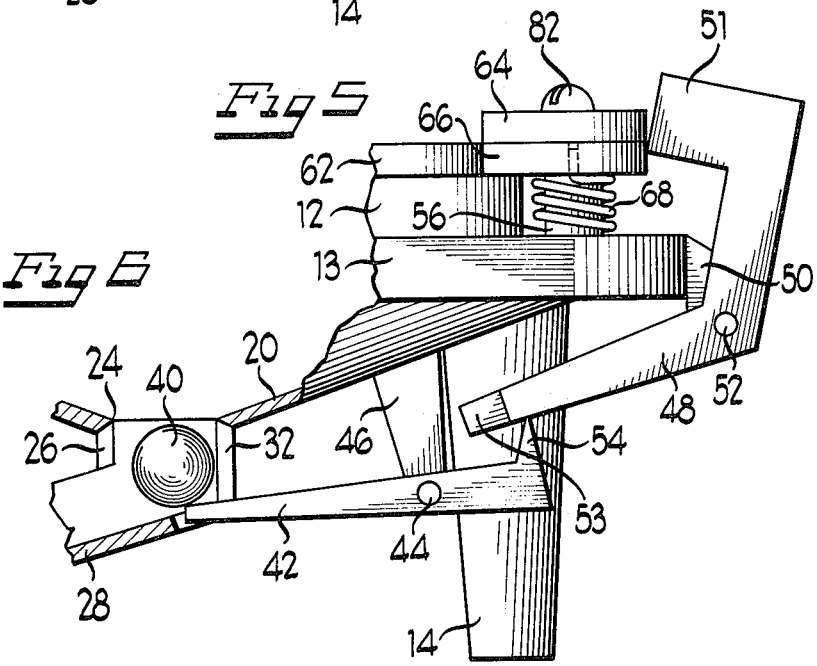
FIG. 5 is a fragmented enlarged side view, partly in section, of the shutter drive mechanism.

A lever 42 (FIGS. 4 and 5) is suspended and vertically pivotable upon a pivot 44 which is supported by a support member 46. Support member 46 depends from the underside of the conical surface 20. One end of lever 42 extends through the slot 32 in the tubular section 26. The other end of the lever 42 terminates in an upwardly extending pointed tab 54.

A second support member 50 (FIGS. 4 and 5) is attached to the lip 13 and angles rearwardly and downwardly therefrom. A second lever 48 is pivotably mounted on a pivot 52 mounted upon the support member 50. The lever 48 is somewhat U-shaped. One arm of the U-shape terminates in a weighted section 53 while the other arm 51 abuts a shutter mounting mechanism, about to be described. The weighted end of lever 48 engages the tab 54 of the lever 42.

Figure 6:
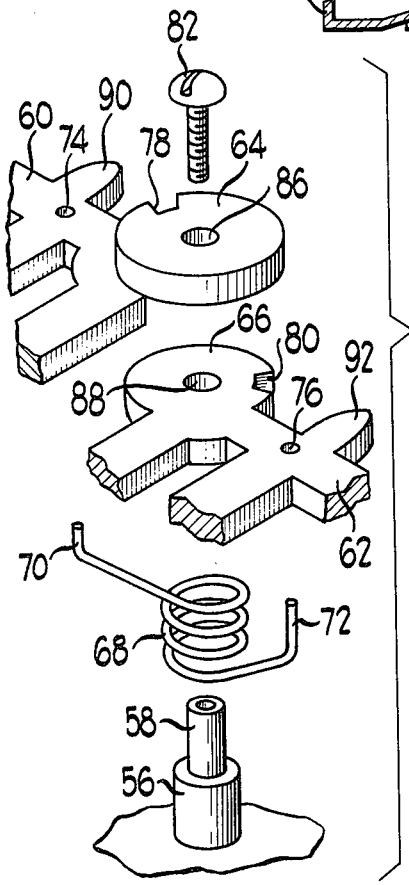
FIG. 6 is an enlarged exploded perspective view of the shutter mounting mechanism.

The shutter mounting mechanism is best shown in FIG. 6. It includes a collar 56 mounted centrally on the rear side of the frame 11. Extending upwardly from the collar 56 is a tubular shaft 58, having a smaller diameter than collar 56. Shutters 60 and 62 are generally rectangular units having elongated slots 63 extending therethrough. Each of the shutters 60 and 62 have circular shutter mounting members 64 and 66. The mounting members 64 and 66 are located at the inner rear corner of the shutters 60 and 62, mounting member 64 of shutter 60 being displaced upwardly by one shutter thickness. Each mounting member has a central bore 86 and 88 which receives the tubular shaft 58.

A coil spring 68 is mounted about the collar 56. The ends 70 and 72 of the spring 68 are formed to extend upward and are received in holes 74 and 76. In the normal unstressed position spring 68 holds shutters 60 and 62 in the closed position. Shutters mounting members 64 and 66 and spring 68 are held in place on the shaft 58 and collar 56 by a flathead screw 82 which is threadedly received in shaft 58.

Notches 78 and 80 are located along the periphery of the mounting members 64 and 66. When the shutters 60 and 62 are in the open position to reveal the card receptacle area 15 the notches are in vertical alignment. The end of arm 51 is then forced into the aligned notches 78 and 80 (as seen in FIGS. 3 and 4) by the weight 53 thereby preventing sring 68 from closing the shutters 60 and 62. Pointed extensions 90 and 92 (FIG. 3) on the shutters 60 and 62 respectively steady the shutters and arm 51 when the shutters are in the open position.

Posts 94 and 96 extend upwardly from the inner front corners of shutters 60 and 62, respectively. The shutters 60 and 62 are forced open against the urging of spring 68 by manual force applied to posts 94 and 96.

A post 104 is centrally disposed upon the top of the front of ridge 12. When the shutters 60 and 62 are released, spring 68 urges the shutters to pivot about the shaft 58 until the shutters cover card receptacle 15. The shutters 60 and 62 are limited in the closing travel by the post 104 which nests within semicircular notches 106 and 108 in the meeting surfaces of the shutters 60 and 62.

As part of the timer mechanism, a ball 40 is inserted by a player into the opening 36 through which it falls onto the surface 20. The path of travel of the ball then being a descending or involuted helix around the aperture 24. The dimensions of the path of travel of the ball 40 and hence the interval of time necessary to complete the path of travel depends upon the force with which the ball 40 is inserted into the opening 36 and the spin, if any, placed upon the ball. The interval of time necessary for the ball 40 to ravel and reach the aperture 24 will therefore be different each time the ball 40 is played or propelled.

The ball 40 is sufficiently heavy that when the ball passes through the aperture 24 downward force is applied to lever 42 to cause it to pivot about the pivot 44 thereby applying upward force through the tab 54 to the weighted arm 53 of lever 48. Lever 48 then will pivot around its pivot 52 so that the arm 51 moves out of the notches 78 and 80. The spring 56 will then cause the shutters 60 and 62 to rotate to a closed position over the card receptacle 15.

After passing the lever 42 the ball 40 rolls down the trough 28 until it abuts the end wall 30. The ball may then be removed to be used again for subsequent play after the shutters have been reopened and locked in place by means of the arm 51 and the notches 78 and 80.

Figure 7:
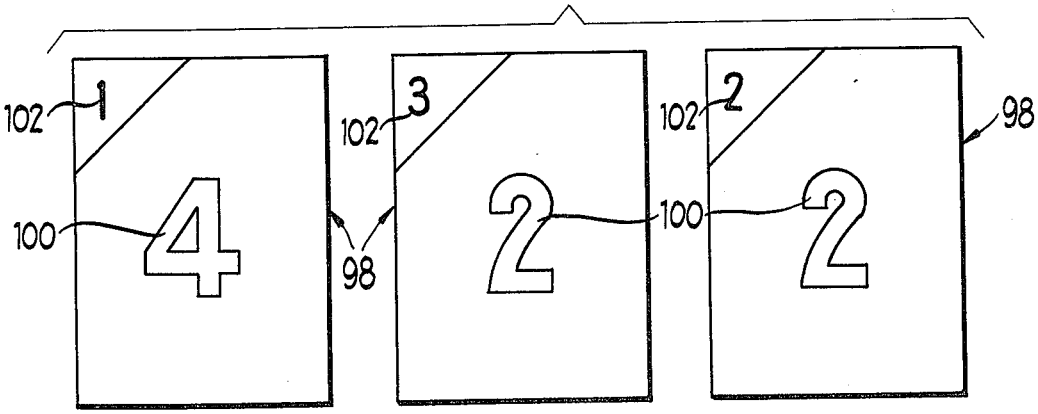
FIG. 7 is a plan view of a plurality of playing cards employed in the game of this invention.

Multiple playing cards, three of which are generally designated 98 in FIG. 7, are played by tossing the cards 98 into receptacle 15 when the shutters 60 and 62 are in the open position shown in FIG. 1. The cards 98 are generally rectangular in shape and have imprinted on their surface a prominently displayed first number designated 100 and a smaller second number designated 102 displayed in the upper lefthand corner. The first prominent number 100 designates the card number. The second smaller number 102 designates the number of the next card 98 to be played by the next player. The players, in seriatim, play or toss cards into the receptacle 15 as determined by the prior card until the shutters close. The player next to play but unable to do so because of the closure of shutters 60 and 62 is out of the game. Thus, it can be seen that speed, manual dexterity, timing and observation all form a part of a player's play of the game.

The foregoing detailed description has been given for clearness of understanding only and no unnecessary limitations should be understood therefrom as certain modifications will be obvious to those skilled in the art.

I claim:

1. A game apparatus, comprising:

a frame;

a receptacle mounted on said frame;

pivotally mounted, generally planar closure means for said receptacle and adapted to cover said receptacle;

at least one playing piece adapted to be deposited in said receptacle by a player of the game; and timing means operatively associated with said closure means and adapted on actuation after an interval of time to cause said closure means to cover said receptacle thereby preventing a player from depositing said playing piece in said receptacle.

2. The game apparatus of claim 1 wherein said timing means has gravity operable means providing a random interval of time for closing said closure means.

3. A game apparatus, comprising:

a frame;

a receptacle mounted on said frame;

movable closure means for said receptacle and adapted to cover said receptacle, at least one playing piece adapted to be deposited in said receptacle by a player of the game, said closure means comprising a pair of shutters pivotally mounted on said frame and adapted to close said receptacle; and timing means operatively associated with said closure means and adapted on actuation after an interval of time to cause said closure means to cover said receptacle thereby preventing a player from depositing said playing piece in said receptacle.

4. A game apparatus, comprising:

a frame;

a receptacle mounted on said frame;

movable closure means for said receptacle and adapted to cover said receptacle, at least one playing piece adapted to be deposited in said receptacle by a player of the game; and timing means operatively associated with said closure means and adapted on actuation after an interval of time to cause said closure means to cover said receptacle thereby preventing a player from depositing said playing piece in said receptacle, said timing means including an inverted conical surface on said frame and adapted to receive a ball movable along the inside of said conical surface for actuating said closure means at a particular point along the conical surface.

5. A game apparatus, comprising:

a frame;

a receptacle mounted on said frame;

movable closure means for said receptacle and adapted to cover said receptacle;

a plurality of playing pieces in the form of numbered cards, said playing pieces being adapted to be deposited in said receptacle by players of the game, each card having at least two numbers printed thereon, the first number on each card being the designation number of the card and the second number being the indicator of the number of the next card to be played into the receptacle; and timing means operatively associated with said closure means and adapted on actuation after an interval of time to cause said closure means to cover said receptacle thereby preventing a player from depositing another playing piece in said receptacle.

6. The game apparatus of claim 5 wherein said first number on each card is more dominant than the second number.

7. A game apparatus, comprising:

a frame;

a receptacle mounted on said frame;

movable closure means for said receptacle and adapted to cover said receptacle;

a plurality of playing pieces adapted to be deposited in said receptacle, said playing pieces being in the form of cards each having a first indicating means designating the respective card and a second indicating means designating the next card to be played into the receptacle; and timing means operatively associated with said closure means and adapted on actuation after an interval of time to cause said closure means to cover said receptacle thereby preventing a player from depositing a playing card in said receptacle.

8. The game apparatus of claim 7 wherein said timing means has means providing a random interval of time for closing said closure means.

9. The game apparatus of claim 7 wherein said closure means comprises a pair of shutters pivotally mounted on said frame and adapted to close said receptacle.

10. A game apparatus, comprising:

a frame;

a receptacle mounted on said frame;

a pair of shutters rotatably mounted on said frame and adapted on actuation to close over said receptacle;

a plurality of cards, said cards having at least two numbers printed thereon, the first number on each card being the designation number of the card and the second number being the indicator of the next card to be played by a player of the game by depositing in said receptacle; and a random timing apparatus adapted to activate said shutters to close said receptacle after a random interval of time thereby preventing a player from depositing a card in said receptacle.

11. The game apparatus of claim 10 wherein said random timing means includes an inverted conical surface beneath said receptacle hidden from view and adapted to receive a ball movable along the inside of the conical surface for actuating said shutters at a particular point along the conical surface.

12. The game apparatus of claim 11 wherein said ball falls through an aperture at the bottom of the conical surface to thereby actuate said shutters.

* * * * *